US006427862B1

(12) United States Patent
Hsu

(10) Patent No.: US 6,427,862 B1
(45) Date of Patent: Aug. 6, 2002

(54) SELF-OPENING CAN

(76) Inventor: Ming-Tang Hsu, No. 3-2, Ta-Chiu Yuan, Ta-Chi Tsun, Ming-Hsiung Hsiang, Chiayi Hsien (TW)

( * ) Notice: Subject to any disclaimer, the term of this patent is extended or adjusted under 35 U.S.C. 154(b) by 15 days.

(21) Appl. No.: 09/707,529

(22) Filed: Nov. 7, 2000

(51) Int. Cl.[7] ..... B65D 17/40

(52) U.S. Cl. ..... 220/276; 220/359.2; 220/359.4; 220/254.1

(58) Field of Search ..... 220/270, 276, 220/359.1, 359.2, 359.3, 359.4, 254.1

(56) References Cited

U.S. PATENT DOCUMENTS 4,363,582 A * 12/1982 Bloeck et al. ..... 220/359.1
4,756,443 A * 7/1988 Murayama ..... 220/270
4,988,013 A * 1/1991 Kobayashi et al. ..... 220/276
5,069,355 A * 12/1991 Matuszak ..... 220/276
5,353,943 A * 10/1994 Hayward ..... 220/276
5,395,005 A * 3/1995 Yoshida ..... 220/276
5,725,120 A * 3/1998 Ramsey et al. ..... 220/276
6,036,043 A * 3/2000 Erfgen et al. ..... 220/276
6,145,689 A * 11/2000 Kobayashi et al. ..... 220/276

* cited by examiner

*Primary Examiner*—Nathan J. Newhouse
(74) *Attorney, Agent, or Firm*—Merchant & Gould P.C.

(57) ABSTRACT

A self-opening can includes a container, and a rim member which has an outer peripheral portion sealingly joined to an edge of the container and an inner peripheral portion extending inwardly of the outer peripheral portion and confining an opening. The inner peripheral portion has a groove which extends around the opening. A filler of non-metallic plastic material fills and is exposed from the groove. A cover panel closes the opening and extends to the inner peripheral portion of the rim member. The cover panel has a layer of non-metallic plastic material which is connected sealingly to the filler.

6 Claims, 9 Drawing Sheets

SELF-OPENING CAN

BACKGROUND OF THE INVENTION

1. Field of the Invention

This invention relates to a self-opening can, more particularly to a self-opening can with an enhanced sealing effect.

2. Description of the Related Art

Referring to FIG. 1, a conventional self-opening can is shown to include a container 1 which has a longitudinal wall 10 with an edge 101 confining an opening 11. A rim member 12 has an outer peripheral portion 121 which is sealingly joined to the edge 101, and an inner peripheral portion 122 which extends inwardly of the outer peripheral portion 121. A plastic cover member 2 includes a peripheral wall with a groove 21 which extends therein and in which the inner peripheral portion 122 is inserted securely, and a cover panel 22 which closes the opening 11. A separable weakened seam 221 is formed between the peripheral wall and the cover panel 22. An opening tab 222 is connected to the cover panel 22 adjacent to the seam 221 such that the cover panel 22 can be broken from the seam 221 by pulling the opening tab 222. However, when the formation of the groove 21 and the inner peripheral portion 122 is not precise, the sealing effect between the rim member 12 and the cover member 2 will be adversely affected.

SUMMARY OF THE INVENTION

The object of the present invention is to provide a self-opening can which has an enhanced sealing effect.

According to this invention, the self-opening can includes a container which has a receiving space and a longitudinal wall surrounding the receiving space. The longitudinal wall has an edge which extends around one end of the receiving space. A rim member has an outer peripheral portion which is sealingly joined to the edge, and an inner peripheral portion which extends inwardly of the outer peripheral portion and which confines an opening for access to the receiving space. The inner peripheral portion has a groove which extends around the opening. A filler of non-metallic plastic material fills the groove and is exposed from the groove. A cover panel closes the opening and extends to the inner peripheral portion of the rim member. The cover panel has a layer of non-metallic plastic material which is connected sealingly to the filler.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
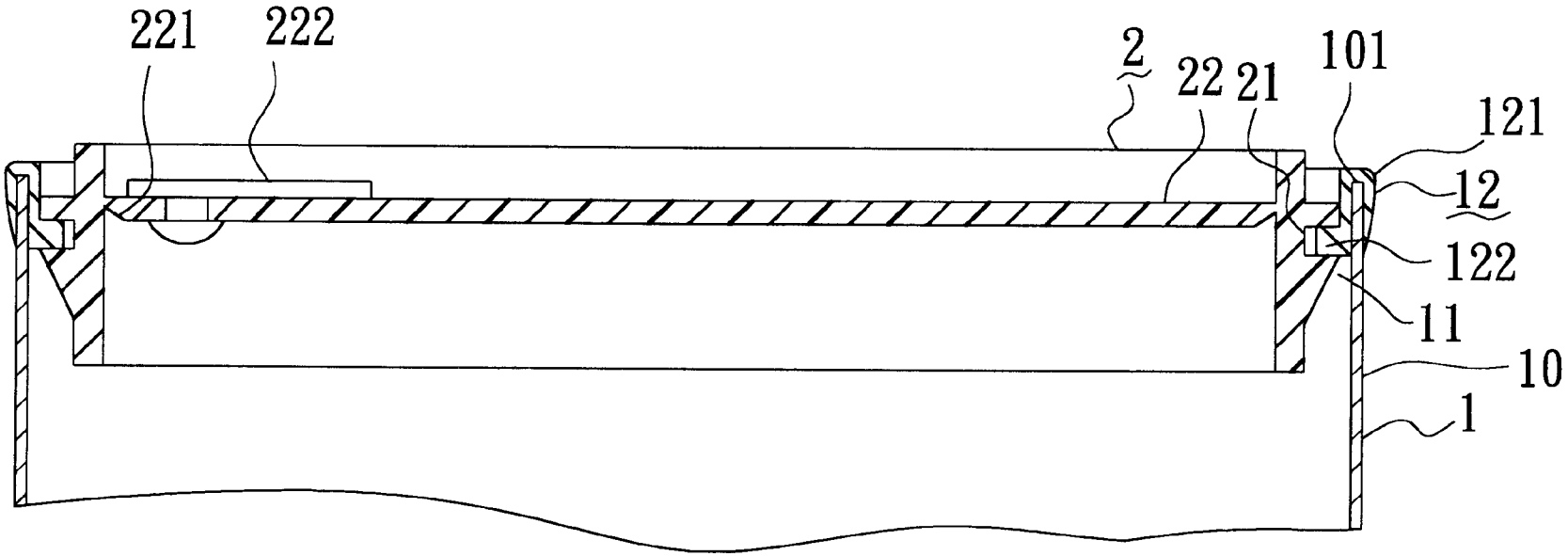
FIG. 1 PRIOR ART
FIG. 1 is a fragmentary sectional view of an end of a conventional self-opening can.

Before the present invention is described in greater detail, it should be noted that same reference numerals have been used to denote like elements throughout the specification.

Figure 2:
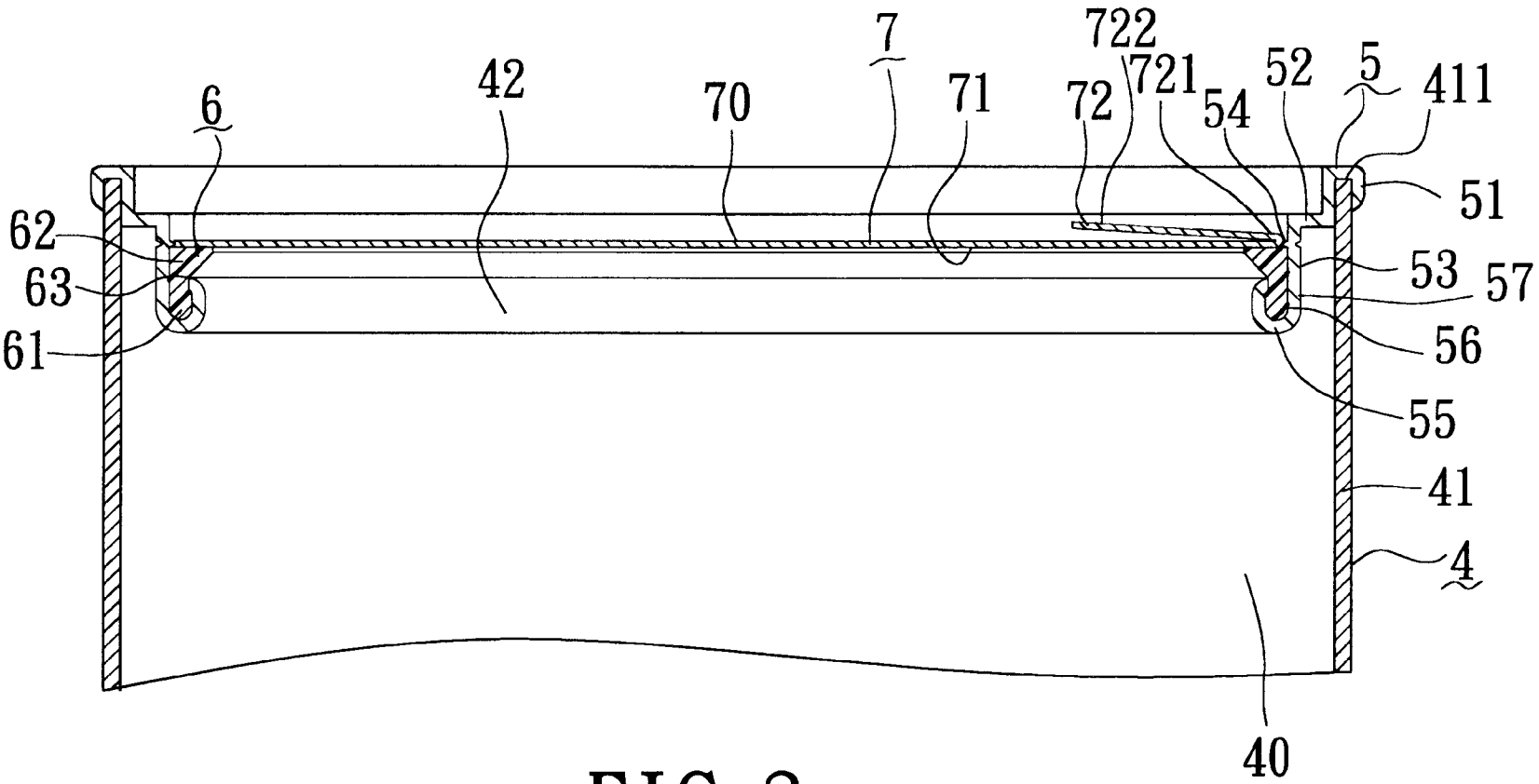
FIG. 2 is a fragmentary sectional view of a first preferred embodiment of an end of a self-opening can according to this invention.
Figure 3:
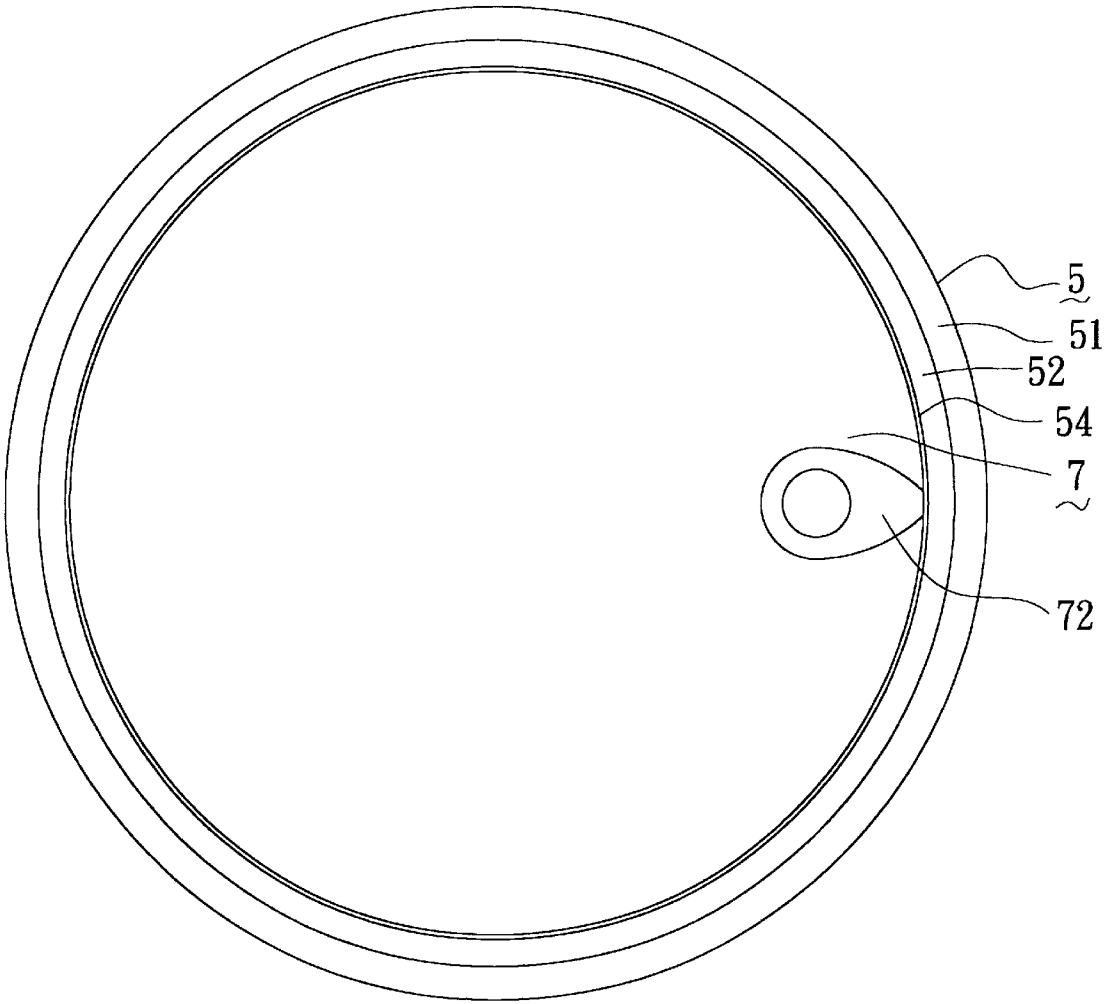
FIG. 3 is a top view of the first preferred embodiment.

Referring to FIGS. 2 and 3, the preferred embodiment of the self-opening can according to the present invention is shown to comprise a circular container 4 which has a receiving space 40 and a longitudinal wall 41 that surrounds the receiving space 40. The longitudinal wall 41 has an edge 411 which extends around one end of the receiving space 40. A rim member 5 has an outer peripheral portion 51 which is sealingly joined to the edge 411 and which abuts against the longitudinal wall 41, an inner peripheral portion 53 which extends inwardly of the outer peripheral portion 51 and which confines an opening 42 for access to the receiving space 40, and an intermediate portion 52 which extends between the inner and outer peripheral portions 53,51 and which projects transversely and inwardly from the longitudinal wall 41. The inner peripheral portion 53 is bent from the intermediate portion 52 to project longitudinally and inwardly so as to form a tubular portion 57 which defines the opening 42. The inner peripheral portion 53 is further bent transversely and inwardly from the tubular portion 57 to make a U-turn 55 so as to form a groove 56 around the opening 42.

A filler of non-metallic plastic material is in the form of a loop-shaped member 6 which has one end 61 that is fitted within the groove 56 and an opposite another end 62 that projects out of the groove 56. The tubular portion 57 extends around the opposite another end 62 of the loop-shaped member 6, and has a retention protrusion 54 to engage the opposite another end 62 so as to prevent the filler from being released from the groove 56. An engaging slot 63 is formed between the one end 61 and the opposite another end 62 to engage a distal end of the U-turn 55 tightly.

A cover panel 7 is disposed to close the opening 42, and extends to the inner peripheral portion 53 of the rim member 5. In this embodiment, the cover panel 7 has a layer of paper 70 and a layer of non-metallic plastic material 71, such as PE or PP film, which is coated on the layer of paper 70 and which is heat sealed (such as by high frequency sealing) to the opposite another end 62 of the loop-shaped member 6. Thus, there is an enhanced sealing effect between the filler and the cover panel 7. In addition, an opening tab 72 has a connecting part 721 which is connected to the cover panel 7, and a handle part 722 which extends from the connecting part 721 and which can be pulled to separate the cover panel 7 from the filler so as to tear off the cover panel 7.

In assembly, the loop-shaped member 6 is first fitted within the groove 56 and abuts against the retention protrusion 54. Then, the distal end of the U-turn 55 is inserted into the engaging slot 63. Subsequently, the cover panel 7 is connected sealingly to the loop-shaped member 6 by virtue of the plastic film 71. Finally, the outer peripheral portion 51 is sealingly joined to the edge 411 of the container 4 so as to close the opening 42.

Figure 4:
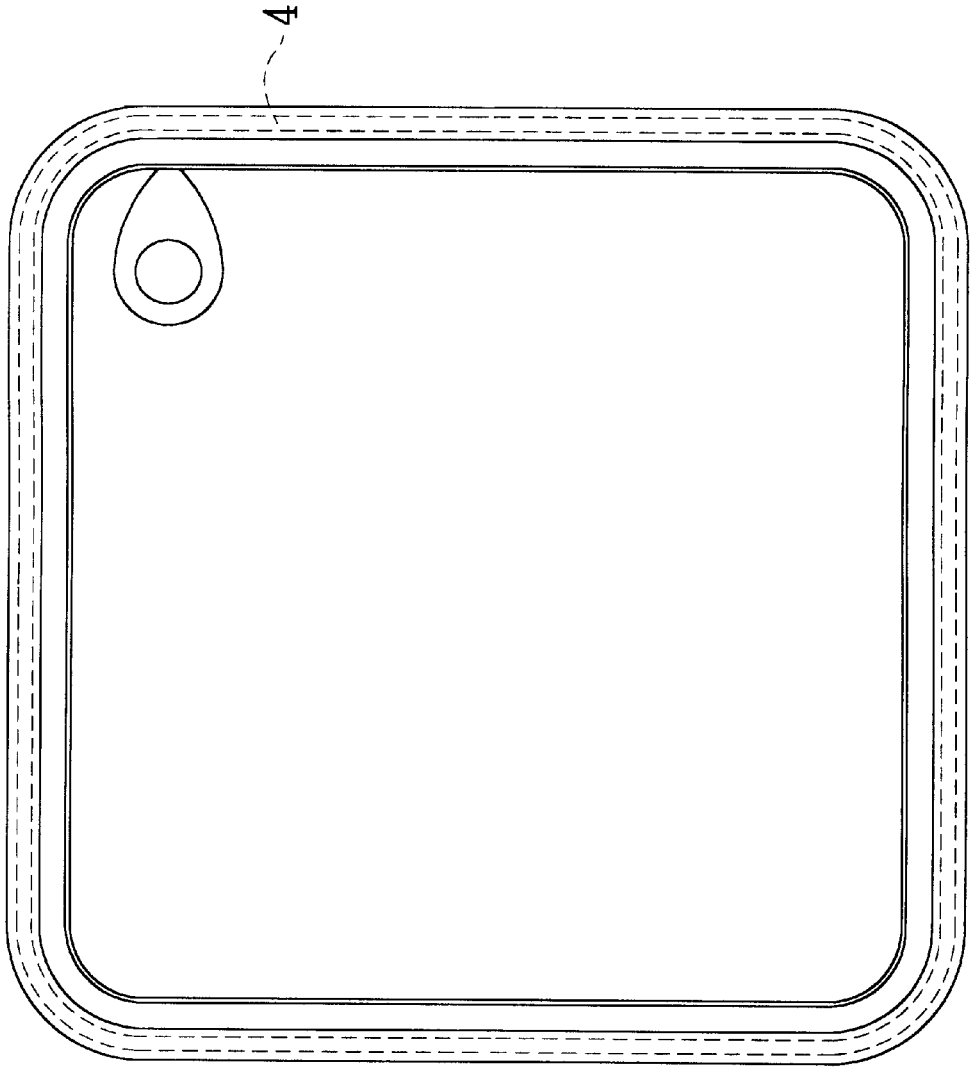
FIG. 4 is a top view of a second preferred embodiment of the self-opening can according to this invention.

The self-opening can of this invention can have a rectangular container 4 as shown in FIG. 4, or a hexagonal container (not shown).

Figure 5:
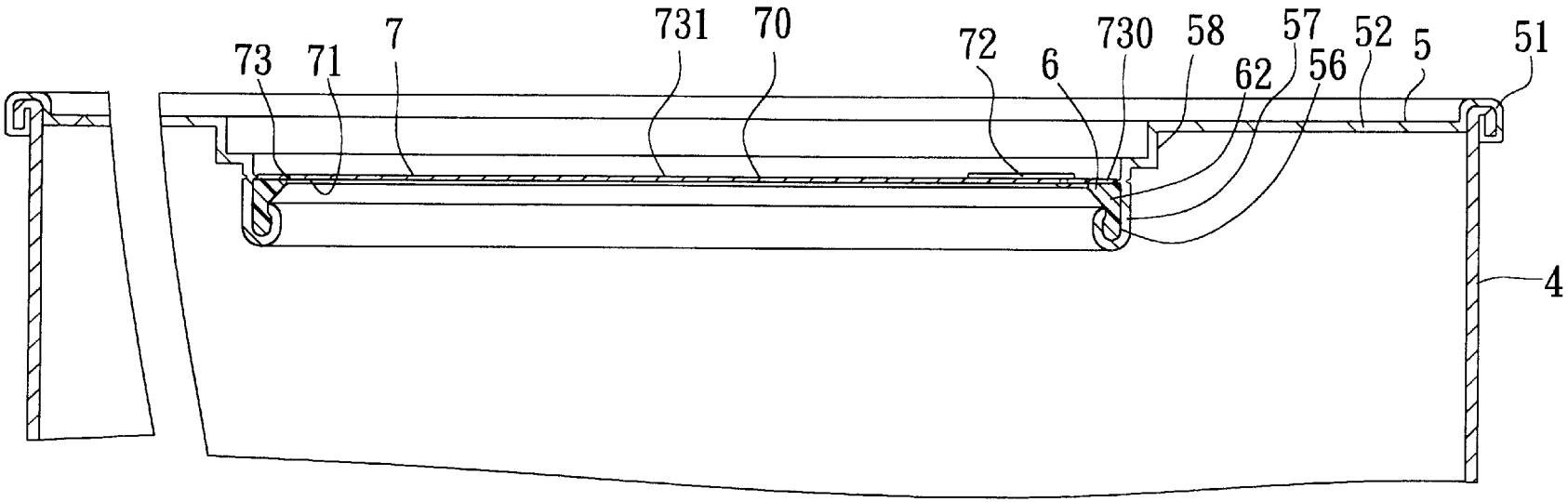
FIG. 5 is a fragmentary sectional view of a third preferred embodiment of an end of the self-opening can according to this invention.
Figure 6:
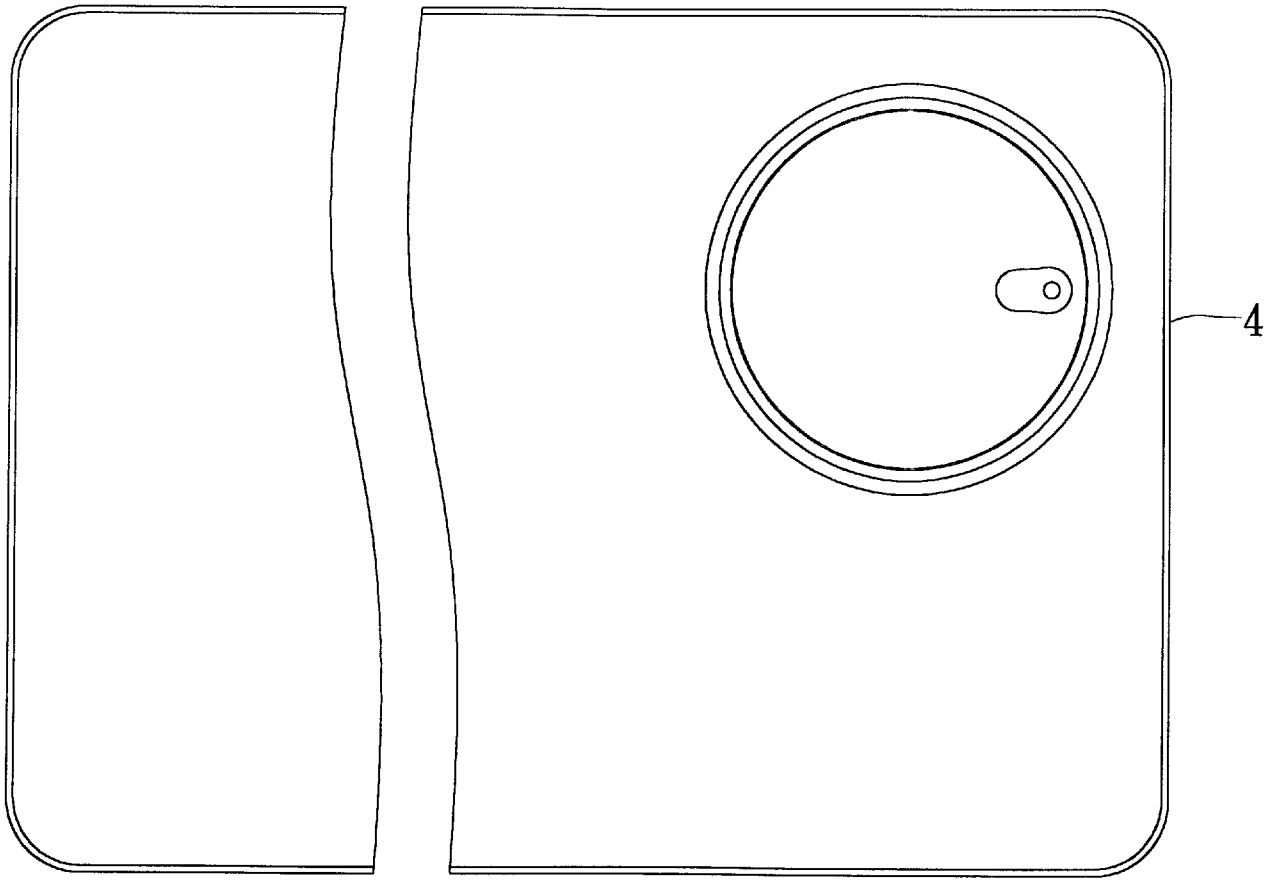
FIG. 6 is a top view of the third preferred embodiment.

As shown in FIGS. 5 and 6, the self-opening can of the third preferred embodiment according to this invention has a container 4 of a larger dimension, such as a container for oil. As compared to the first preferred embodiment, the rim member 5 of the self-opening can further has a stepped ring portion 58 which interconnects the intermediate portion 52 and the tubular portion 57. In addition, the outer peripheral portion 51 is connected integrally to the edge of the container 4. Moreover, the cover panel 7 includes a metal layer 70, such as aluminum, and a plastic film 71. To facilitate tearing of the cover panel 7, the cover panel 7 has a lateral portion 730 which is connected to the filler 6, a removable region 731 which is surrounded by the lateral portion 730, and a separable weakened seam 73 which is formed between the lateral portion 730 and the removable region 731. The opening tab 72 is attached to the removable region 731 adjacent to the lateral portion 730.

Figure 7:
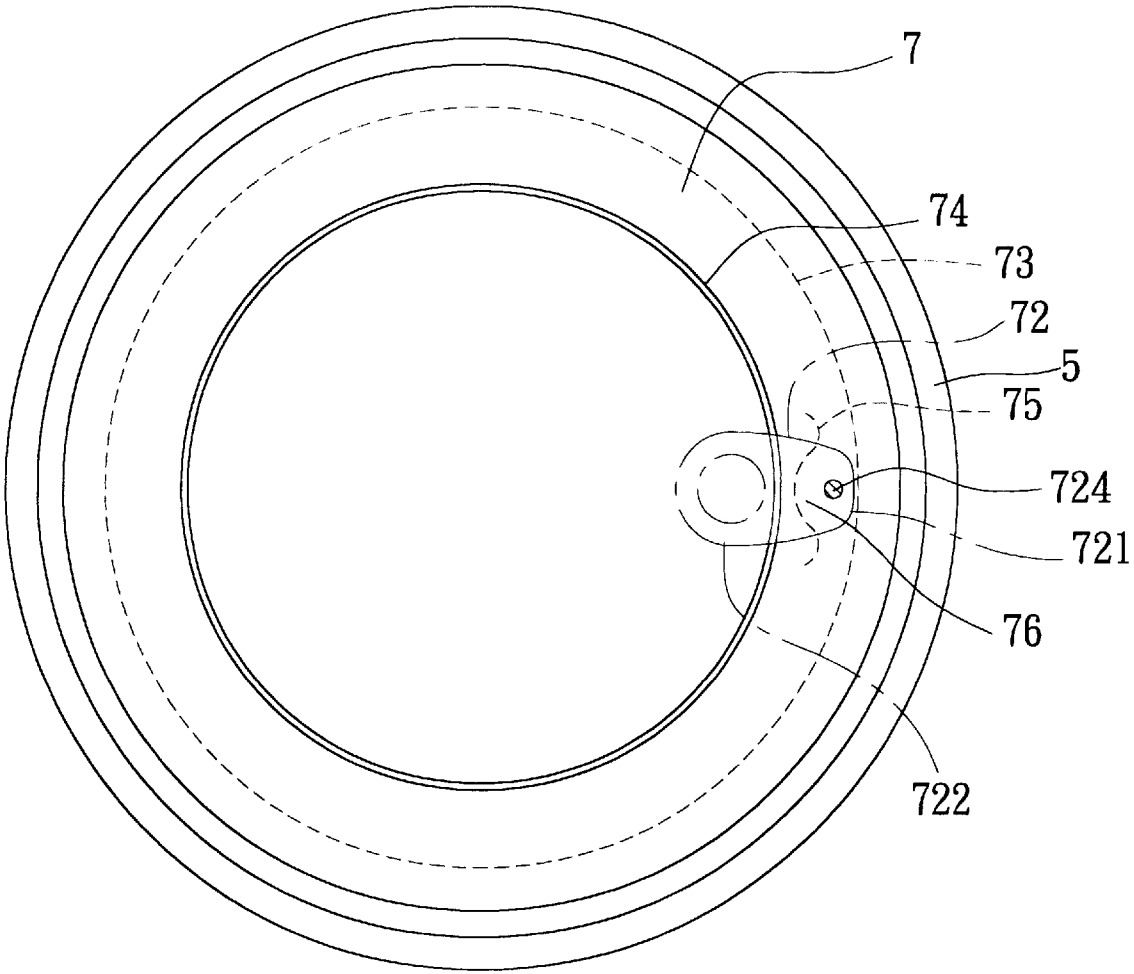
FIG. 7 is a top view of a fourth preferred embodiment of the self-opening can according to this invention.
Figure 8:
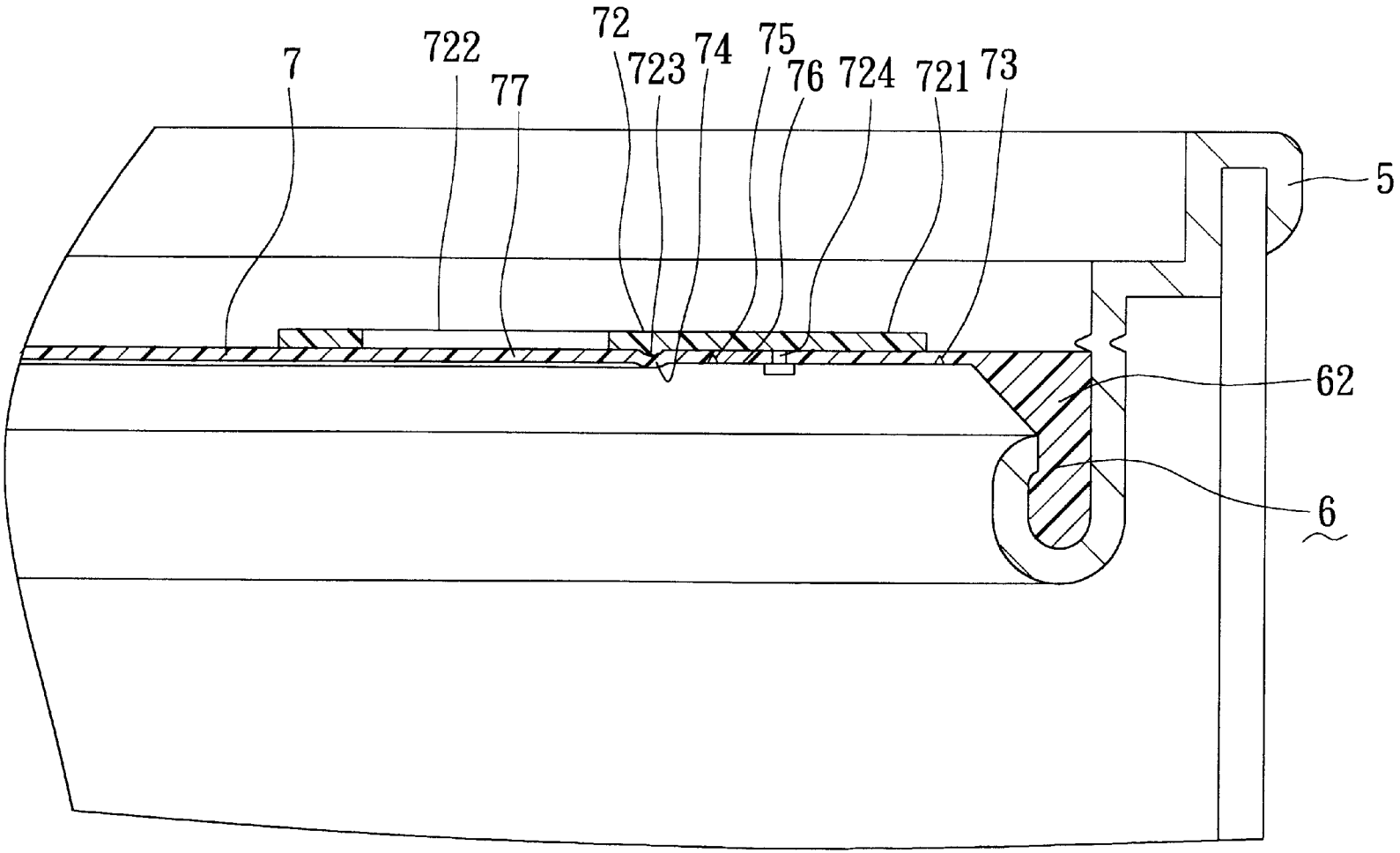
FIG. 8 is a fragmentary sectional view of the fourth preferred embodiment.
Figure 9:
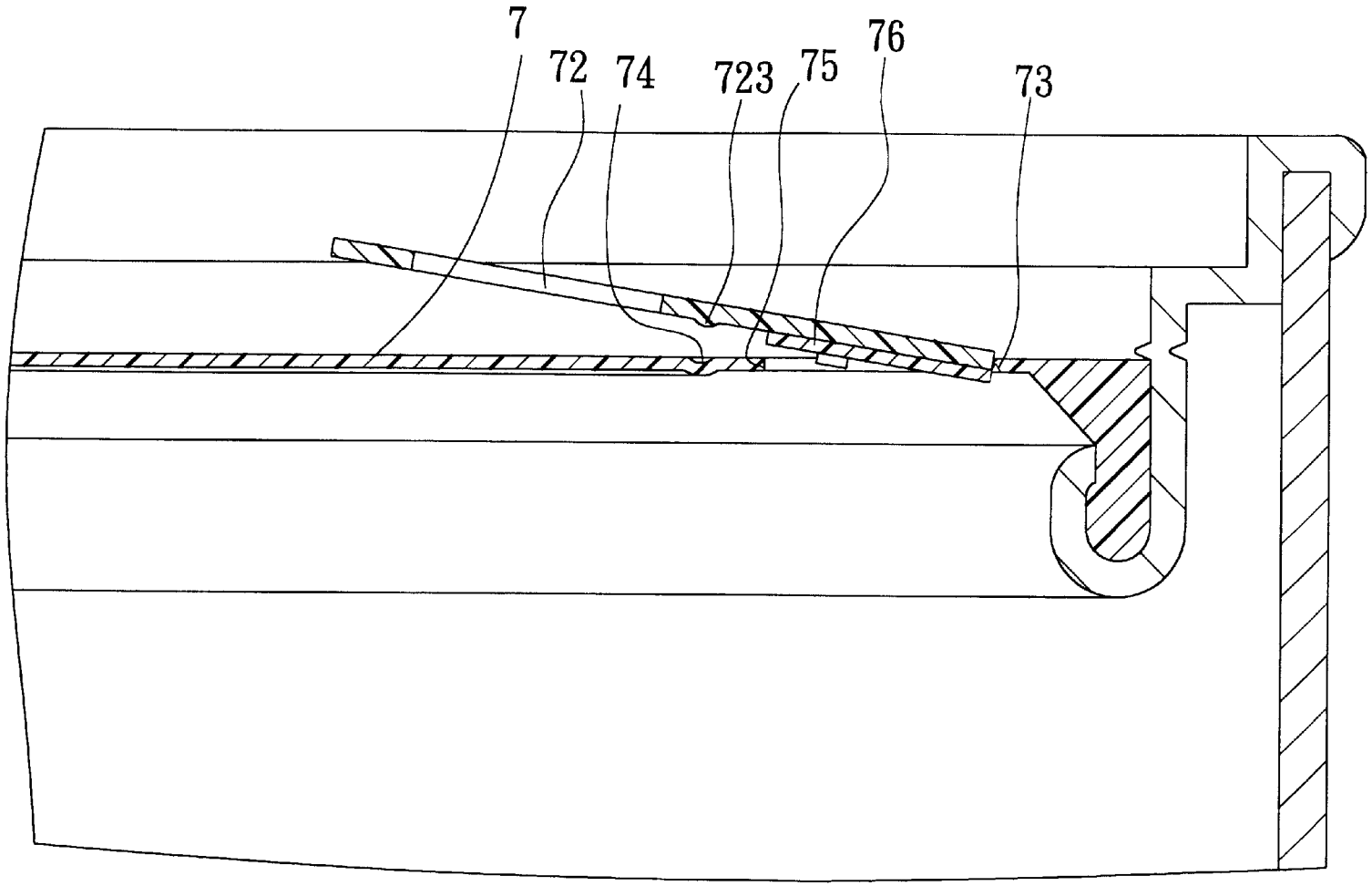
FIG. 9 is a fragmentary sectional view of the fourth preferred embodiment when opened.

Referring to FIGS. 7, 8 and 9, the fourth preferred embodiment of the self-opening can is shown to be similar to the first preferred embodiment in construction, except that the cover panel 7 and the filler 6 are formed as an integrally molded body. The cover panel 7 is connected integrally to the end 62 of the filler 6, and includes a removable region 77 which is formed within the end 62 of the filler 6. A separable weakened seam 73 is formed between the end 62 and the removable region 77. The cover panel 7 further has a tab holding part 76 which is adjacent to the separable weakened seam 73 and which is connected to the connecting part 721 of the opening tab 72 by means of a rivet 722. A serpentine breakable line 75 is formed at one side of the tab holding part 76 opposite to the separable weakened seam 73. The cover panel 7 further has a loop-shaped crease line 74 which extends in the removable region 77, and the opening tab 72 has a protrusion 723 engaging the loop-shaped crease line 74 to position the opening tab 72 on the cover panel 7.

With reference to FIG. 9, when the handle part 72 of the opening tab 7 is pulled upwardly, the protrusion 723 is separated from the loop-shaped crease line 74, and the breakable line 75 is broken. Then, the cover panel 7 is broken off from the separable weakened seam 73. Note that the crease line 74 is provided to compensate shrinkage occurring upon cooling of the molded body of the cover panel 7.

As illustrated, by virtue of the sealing connection between the rim member 5 and the filler 6, and by virtue of the sealing connection between the plastic film 70 and the filler 6, an enhanced sealing effect for the opening 42 of the container 4 can be achieved.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A self-opening can comprising:

a container having a receiving space and a longitudinal wall surrounding said receiving space, said wall having an edge extending around one end of said receiving space;

a rim member having an outer peripheral portion sealingly joined to said edge, and an inner peripheral portion extending inwardly of said outer peripheral portion and confining an opening for access to said receiving space, said inner peripheral portion having a groove extending around said opening;

a filler of non-metallic plastic material filling said groove and exposed from said groove;

a cover panel closing said opening and extending to said inner peripheral portion of said rim member, said cover panel having a layer of non-metallic plastic material connected sealingly to said filler; and an opening tab having a connecting part connected to said cover panel, and a handle part extending from said connecting part;

wherein said rim member further includes an intermediate portion extending between said inner and outer peripheral portions, said outer peripheral portion abutting against said longitudinal wall, said intermediate portion projecting transversely and inwardly from said longitudinal wall, said inner peripheral portion being bent from said intermediate portion to project longitudinally and inwardly so as to form a tubular portion which define said opening, said inner peripheral portion being further bent transversely and inwardly from said tubular portion to make a U-turn so as to form said groove.

2. A self-opening can of claim 1, wherein said filler is a loop-shaped member having one end fitted within said groove and an opposite another end projecting out of said groove, said tubular portion extending around said another end of said loop-shaped member and having a retention protrusion to engage said another end so as to prevent said filler from being released from said groove.

3. A self-opening can of claim 2, wherein said cover panel and said filler are formed as an integrally molded body, said cover panel being connected integrally to said another end of said filler, and including a removable region formed within said another end of said filler, and a separable weakened seam formed between said another end of said filler and said removable region, said opening tab being attached to said removable region adjacent to said separable weakened seam.

4. A self-opening can of claim 3, wherein said cover panel further has a loop-shaped crease line extending in said removable region.

5. A self-opening can of claim 4, wherein said removable region of said cover panel has a tab holding part adjacent to said separable weakened seam and connected to said opening tab, and a breakable line formed at one side of said tab holding part opposite to said separable weakened seam, said connecting part of said opening tab being attached to said tab holding part between said breakable line and said separable weakened seam.

6. A self-opening can of claim 2, wherein said rim member further has a stepped ring portion interconnecting said intermediate portion and said tubular portion of said inner peripheral portion.

* * * * *